US005507985A

United States Patent [19]

Cadorniga

[11] Patent Number: 5,507,985

[45] Date of Patent: Apr. 16, 1996

[54] METHOD OF MAKING A FOAMED CORE GOLF CLUB HAVING A CORE DENSITY GRADIENT

[75] Inventor: Lauro C. Cadorniga, Piedmont, S.C.

[73] Assignee: Dunlop Slazenger Corporation, Greenville, S.C.

[21] Appl. No.: 399,444

[22] Filed: Mar. 7, 1995

Related U.S. Application Data

[62] Division of Ser. No. 182,771, Jan. 18, 1994, Pat. No. 5,465,969.

[51] Int. Cl.[6] ..... B29C 44/18

[52] U.S. Cl. ..... 264/45.3; 264/45.5; 264/46.6; 264/54; 264/DIG. 6

[58] Field of Search ..... 264/45.5, 45.3, 264/46.6, 54, DIG. 6

[56] References Cited

U.S. PATENT DOCUMENTS

| | | | |
|---|---|---|---|
| 4,581,190 | 4/1986 | Nagamoto et al. | 264/137 |
| 4,714,577 | 12/1987 | Nagamoto et al. | 264/46.6 |
| 4,803,023 | 2/1989 | Enomoto et al. | 264/46.6 |
| 4,839,116 | 6/1989 | Puckett et al. | 264/54 |
| 4,988,104 | 1/1991 | Shiotani et al. | 273/169 |
| 5,135,227 | 8/1992 | Okumoto et al. | 264/45.3 |
| 5,185,914 | 2/1993 | Petruccelli et al. | 29/460 |
| 5,348,302 | 9/1994 | Sasamoto et al. | 273/169 |

*Primary Examiner*—Allan R. Kuhns
*Attorney, Agent, or Firm*—Lorusso & Loud

[57] ABSTRACT

A wood type metal golf club head having a hollow metal head and the cavity within filled with a thermoplastic material produced from a thermoplastic polymer, filler and chemical blowing agent in a manner so that the material in the cavity has a dense outer skin adjacent the surfaces of the cavity and a cellular central area and the finished product reduces the undesirable metallic sound made during hitting.

7 Claims, 1 Drawing Sheet

METHOD OF MAKING A FOAMED CORE GOLF CLUB HAVING A CORE DENSITY GRADIENT

This is a divisional of application(s) Ser. No. 08/182,771, filed on Jan. 18, 1984, now U.S. Pat. No. 5,465,969.

BACKGROUND OF THE INVENTION

The present invention relates generally to the type of golf club heads called metal-wood golf club heads, and more particularly to a cast metal wood golf club head having an improved feel and sound to the golfer during hitting. The present invention also provides an improved method to manufacture such a golf club head.

Golf club heads, particularly "metal woods", have a metal body with a generally flat sole plate, a generally rounded top and a generally flat face extending between them, that face being adapted to strike the ball when the club is swung by means of a shaft. In the production of known metal wood heads, the metal body is formed hollow and a foam material is filled into the cavity in the metal body. The foam material is used so as to reduce an undesirable metallic sound that is made by an empty metal wood head during hitting. The foam material is designed to have a consistent cellular structure throughout the cavity. In practice, however, that consistency is hard to achieve and voids often form in the foam, making for unpredictability in hitting the golf ball because of the difference in a solid hit often identified through the reduction in the metallic sound and feel through the swing process.

Attempts have been made to improve this type of golf club head. U.S. Pat. No. 5,135,227 discloses a metal wood-type golf club head with a hollow metal head body and a core material filling the hollow, wherein the core material is an aggregate of fused expandable beads that form uniformly dispersed cells. A club head according to that invention is supposed to give a lengthened shot and to reduce the metallic sound made during hitting.

SUMMARY OF THE INVENTION

The present invention accomplishes the goals of a more solid feel and a reduced metallic sound when hit by providing the metal wood golf club head having a hollow metal body filled with a foamed thermoplastic polymer formulated to produce a dense outer skin and a cellular core structure in the center portion. The dense outer skin forms at the peripheral areas of the cavity in the golf club head closest to the metal body.

In order to produce such a metal wood golf club head, a core material is formulated, the core material being a thermoplastic material including a thermoplastic polymer and an inorganic filler, preferably microscopic glass bubbles. The core material is manufactured by mixing the thermoplastic polymer and the inorganic filler with a chemical blowing agent. The resulting mixture is injected into the cavity of the metal body. By regulating the amount of the mixture injected, the amount of blowing agent and the other process parameters, the resulting golf club head will have a core material with a dense skin adjacent to the internal wall of the golf club head and a gradient cellular core.

It is therefore an object of the present invention to provide a wood type metal golf club head which has a solid feel and a reduction in the undesirable metallic sound made during hitting.

Another object of the present invention is to provide a process to produce such a wood metal golf club head.

These and other objects and advantages of the present invention will be apparent from the ensuing detailed description of the present invention, taken together with the drawing.

DETAILED DESCRIPTION OF THE INVENTION

Figure 1:
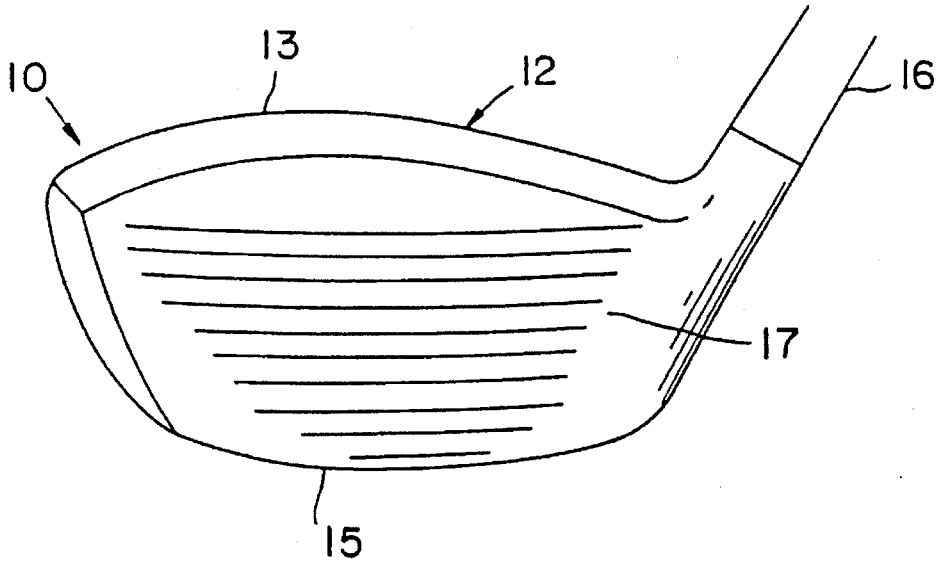
FIG. 1 is a perspective view of the metal wood golf club head of the present invention.
Figure 2:
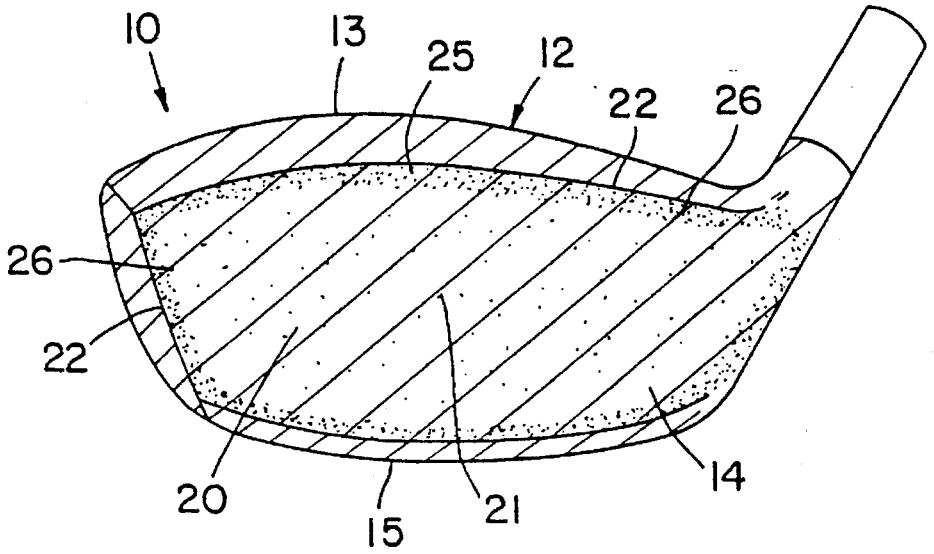
FIG. 2 is a cross-sectional view of the golf club head shown in FIG. 1.

FIGS. 1 and 2 illustrate a golf club head 10 having a hollow metal body 12 and a cavity 14 in its interior. Typically, the metal body of a wood golf club head 10 is composed of a rounded top 13, a generally flat sole plate 15 and a face extending between them 17. A hosel 16 extends from the body 12, to which a shaft (not shown) is fixed. The cavity 14 as shown is filled with a thermoplastic material 20, as defined in the present invention.

With reference to FIG. 2, the cross section of the golf club head 10 illustrates that the density of the thermoplastic material 20 increases from a central area 21 of the thermoplastic material 20 to the surfaces 22 adjacent the metal body 12. The thermoplastic material 20 has an outer dense skin 25 of from, 0.125 inch to 0.625 inch in thickness. Preferably the skin's 25 thickness, which is inversely related to the amount of blowing agent used in making the golf club head, is approximately 0.250 inch. The central area 21 of the golf club head has a blown cellular structure. The boundary 26 between the cellular central area 21 and the skin 25, while not sharply delineated, is observable from an inspection of a cross sectional sample of a golf club head 10 made in accordance with the present invention.

The thermoplastic material 20 filling the cavity 14 of the hollow metal body 12 is a thermoplastic polymer with an inorganic filler distributed uniformly throughout the interstitial spaces of the polymer. The thermoplastic polymer may be the product of the reaction of an olefin and metallic salt of an unsaturated monocarboxylic acid. Suitable ionomer resins for producing the thermoplastis polymer are sold by E. I. Dupont de Nemours Company, Polymer Products Department, Ethylene Polymers Division, Wilmington, Del., 19898, under the trademark SURLYN and IOTEK Ionomers are available from Exxon Chemical Company of Houston Tex. The ionomer resin is available both as a zinc, lithium, magnesium and sodium ionic copolymer. It has been found that each copolymer is useful in carrying out the present invention and that mixtures of the copolymers are likewise useful in carrying out the present invention. Non-neutralized copolymers of ethylene and methacrylic or acrylic acid are also suitable, such as products sold under the trade name NUCREL by Dupont and ATX 325 by Exxon.

A preferred thermoplastic polymer is a polyethylene or polypropylene polymer because of its relative inexpensive cost. In particular, products such as low and high density polyethylene (LDPE and HPDE), are useful and most particularly ESCORENE and ESCOSENSE, trade names of products available from EXXON CHEMICAL, P.O. BOX 3272, Houston, Tex., can be used in the present invention.

The thermoplastic material, as previously stated, includes an inorganic filler, and preferably microscopic glass bubbles serve as the filler or extender. In the finished product the glass bubbles are distributed uniformly throughout the thermoplastic polymer. The glass bubbles which may be used in the present invention are manufactured by the 3M Company, St. Paul, Minn. 55101 and range in density from 0.12 to 0.18 grams per cubic centimeter. Other inorganic fillers such as titanium dioxide or calcium carbonate can be used in manufacturing the golf club head of the present invention. Glass bubbles are preferred because they readily act as a nucleating agent. This material forms in the outer peripheral areas closer to the metal head internal wall, thus producing the integral skin which is a more dense foam structure.

In order to manufacture a golf club head of the above-described composition and having the physical and performance characteristics previously described, the thermoplastic material is formed by injection molding with a blowing agent. Typical blowing agents, such as Freon, nitrogen gas, and carbon dioxide, may be used with the thermoplastic polymer. A suitable chemical blowing agent for carrying out the present invention has a decomposition temperature range between 230° F. and 435° F. Two preferred chemical blowing agents are sold under the trade designation Celogen TSH and Celogen RA by Uniroyal Chemical, Naugatuck, Conn. 06770. NORTECH brand foam concentrate sold by Northern Petro Chemical Company, Clinton, Mass. 01510 also works well.

While the process operates over a wide range of blowing agent decomposition temperatures, higher decomposition temperatures are preferable because the risk of premature expansion can be minimized. Thus decomposition temperatures from 350° F. to 450° F. are preferred. The thickness of the skin 25 of the thermoplastic material is inversely proportional to the amount of blowing agent. For example, reducing the amount of Celogen TSH to 0.50 parts will produce a skin 25 thickness of approximately 0.500 inch in the finished product. Therefore a range of 0.50 to 2.00 parts of blowing agents should produce skin 25 thickness from approximately 0.500 inch to 0.125 inch respectively.

The weight of the filler in the formulation can be varied within a range of from 0.5 to 15 parts, and the weight of the glass bubbles may vary from 0 to 10 parts.

In order to form the metal wood golf club head of the present invention, the ingredients specified for each of the above formulations are first mixed together prior to injection molding.

A conventional screw injection machine typically used to manufacture conventional two-piece molded golf balls can be modified for foam molding a golf club head as described below. The injection nozzle is equipped with a shut-off valve to insure that only a predetermined amount of the mixture is injected into each golf club head body cavity. Particularly, it is desired that only about 5 to 30 grams of the mixture for each golf club head 10 be injected as the club head sizes varies from the Driver to the 7 Metal wood head. The injection machine must generate sufficient injection pressure to be able to inject the material into the mold cavity in one second or less to minimize premature gas expansion to achieve uniform skin 25 thickness for each golf club head 10 molded.

In order to assure that the resulting thermoplastic material 20 has the proper skin 25 thickness, it is important that the process parameters be controlled. The initial temperature of the mixture is room temperature. The club head is held in the mold where it is chilled by 40° F. water to approximately 40° F. to 70° F. The injection cylinder is provided with a temperature gradient along its length to the nozzle. The rear part of the cylinder us kept at a lower temperature (approximately 325° F.) to reduce premature gas expansion, and the nozzle is maintained at a higher temperature (approximately 400° F.) to make rapid injection easier by reducing viscosity of the mixture. The mold is then held closed (elapsed time) for between 60 to 240 seconds (depending on skin thickness) while maintaining the mold temperature at approximately 40° F. to 70° F. The process requires about 60 seconds per 0.125 inch of skin thickness to insure that the skin is fully formed inside metal wood club head.

By mixing the requisite amount of blowing agent and regulating the process within the parameters specified above, the density of the thermoplastic material 20 which fills the cavity 14 of the golf club head 10 will have the requisite skin thickness to provide the sound and feel desired in a metal wood golf club head.

The following formulations have been found to produce an acceptable core material, with a suitable skin thickness of approximately 0.250 inch.

| MATERIALS | PARTS (BY WEIGHT) |
|---|---|
| EXAMPLE 1 | |
| Surlyn Ionomer 8920 (Sodium) | 100 |
| Glass Bubbles (C15/250 by 3M) | 6.25 |
| Celogen TSH | 1.06 |
| EXAMPLE 2 | |
| Surlyn Ionomer 9910 (Zinc) | 100 |
| Glass Bubbles (C15/250 by 3M) | 6.25 |
| Celogen TSH | 1.06 |
| EXAMPLE 3 | |
| Surlyn Ionomer 9910 (Zinc) | 50 |
| Surlyn Ionomer 8940 (Sodium) | 50 |
| Glass Bubbles (C15/250 by 3M) | 6.25 |
| Celogen TSH | 1.06 |
| EXAMPLE 4 | |
| Iotek 8000 (Sodium) | 100 |
| Glass Bubbles (C15/250 by 3M) | 6.00 |
| Celogen TSH | 1.5 |
| EXAMPLE 5 | |
| Iotek 7010 (Zinc) | 100 |
| Glass Bubbles (C15/250 by 3M) | 6.25 |
| Celogen TSH | 1.75 |
| EXAMPLE 6 | |
| ATX 325 | 100 |
| Glass Bubbles (C15/250 by 3M) | 6.25 |
| Celogen TSH | 0.75 |
| EXAMPLE 7 | |
| HDPE (Escosense) | 100 |
| Glass Bubbles (C15/250 by 3M) | 7.25 |
| Celogen TSH | 1.25 |
| EXAMPLE 8 | |
| LDPE (Escorene) | 100 |
| Glass Bubbles (C15/250 by 3M) | 7.25 |
| Celogen TSH | 1.25 |
| EXAMPLE 9 | |
| LDPE (Escorene) | 100 |
| Glass Bubbles (C/15/250 by 3M) | 6.0 |
| Titanium Dioxide | 2.0 |
| NORTECH MF1039 | 1.2 |
| Celogen TSH | 0.15 |

The best results have been achieved with the following process parameters.

| | Value |
|---|---|
| Process Parameter | |
| Initial mold temperature | 40° F.–70° F. |
| Cylinder temperature | |
| rear | 300° F.–350° |
| center | 325° F.–375° F. |
| front | 350° F.–400° F. |
| nozzle | 375° F.–450° F. |
| Screw back pressure | 250 psi |
| cure cycle (elapsed time) | 109 sec. |
| Fill rate | 1 sec. or less |

The typical weight of a metal wood head, incorporating the foamed thermoplastic material as described in the present invention are as follows:

| | |
|---|---|
| Driver | 202 grams |
| 3 wood | 210 grams |
| 5 wood | 217 grams |
| 7 wood | 225 grams |

The foamed core material inside the hollow metal body weighs approximately 5–30 grams for the Driver and slightly varies through the 7 Metal Wood head because of a reduced internal volume. The specific gravity range of the gradient foam structure is spread throughout the metal wood cavity because of the dispersion of cellular to more dense areas: 0.05 to 0.50 g/cm3, depending on final metal wood headweight requirements.

While the invention will be described in connection with a preferred embodiment and process, it will be understood that we do not intend to limit the invention to that embodiment and/or process. On the contrary, we intend to cover all alternatives, modifications and equivalents as may be included within the spirit and scope of the invention as defined by the appended claims.

What is claimed is:

1. A process for manufacturing a metal wood golf club head comprising the steps of:

a. providing a metal wood golf club head having a cavity within a metal body;

b. cooling the metal wood golf club head;

c. forming a mixture of a thermoplastic polymer, a chemical blowing agent and a filler material;

d. injecting in one second or less between 5 and 30 grams of the mixture into the cavity of the cooled metal wood golf club head, the mixture being at a sufficient temperature to activate the blowing agent such that a blown cellular structure is formed; and e. holding the mixture in the cooled golf club head for a time sufficient to form a central to peripheral ascending gradient density composition in the golf club head.

2. The process of claim 1 wherein the mixture comprises by weight approximately 100 parts of the thermoplastic polymer, between 0.5 and 15 parts of the filler material and between 0.25 and 2.0 parts of the blowing agent.

3. The process of claim 2 wherein the mixture is injected by an injector that has an increasing temperature gradient from its inlet to its nozzle so that premature blowing is minimized in the injector and viscosity of the mixture is reduced at the nozzle.

4. The process of claim 2, wherein the golf club head is cooled to approximately 40° F. to 70° F.

5. The process of claim 1, wherein the filler material comprises microscopic hollow glass spheres ranging in density from 0.12 to 0.18 grams per cubic centimeter.

6. The process of claim 1 wherein the thermoplastic polymer is selected from the group consisting of polyethylene and polypropylene polymers and partially neutralized ionomers and non-neutralized copolymers of ethylene and methacrylic/acrylic acid.

7. The process of claim 1 wherein the filler material is selected from the group consisting of microscopic hollow glass spheres, titanium dioxide and calcium carbonate.

* * * * *